United States Patent [19]

Williams et al.

[11] 4,326,362

[45] Apr. 27, 1982

[54] SHOT BLAST MACHINE

[76] Inventors: Virgil R. Williams, 2055 Webb Jin House Rd., Snellville, Ga. 30278; James M. Williams, Jr., 2980 Payton Rd., NE., Atlanta, Ga. 30345

[21] Appl. No.: 122,366

[22] Filed: Feb. 19, 1980

[51] Int. Cl.[3] ..... B24C 3/14; B24C 9/00

[52] U.S. Cl. ..... 51/417; 51/424; 51/426

[58] Field of Search ..... 51/410, 417, 424, 425, 51/426

[56] References Cited

U.S. PATENT DOCUMENTS

| | | | |
|---|---|---|---|
| 1,912,760 | 6/1933 | Coberly | 51/426 X |
| 2,108,210 | 2/1938 | Rosenberger | 51/426 X |
| 2,225,482 | 12/1940 | Mulvany | 51/426 X |
| 2,414,038 | 1/1947 | Gossard | 51/424 |
| 2,604,734 | 7/1952 | Huyett | 51/426 X |
| 3,030,678 | 4/1962 | Huston | 51/424 X |
| 3,626,641 | 12/1971 | Powell | 51/426 X |
| 3,742,651 | 7/1973 | Rowe | 51/425 |
| 3,813,817 | 6/1974 | Haberlin | 51/426 X |

*Primary Examiner*—Nicholas P. Godici
*Attorney, Agent, or Firm*—George M. Thomas

[57] ABSTRACT

Shot moves from the shot propelling device against articles to be cleaned and then falls through the floors of the blast housing and vestibules and accumulates on a canopy over a central auger conveyor. The shot moves about the canopy to the central auger conveyor, and then is conveyed upwardly to the shot separator where it falls in a cascade downwardly to the shot hoppers which feed the shot propellers. Air is directed through the entrance and exit vestibules and then through the cascading shot to a filter, thereby removing the debris from the shot. A roller conveyor assembly has entrance and exit portions which can be detached from a central portion and extended through the blast housing and vestibules for storage.

4 Claims, 5 Drawing Figures

SHOT BLAST MACHINE

BACKGROUND OF THE INVENTION

This invention relates to shot blast machines which are commonly used for cleaning articles made from steel and other metals, wherein streams of small metal particles such as grit or shot are directed against the metal articles. Most shot blast machines are large and extremely heavy, and therefore are difficult to move. Thus, it is customary to bring the metal articles to the shot blast machine for cleaning instead of relocating the shot blast machine to a construction site even though the machine may be remotely located with respect to the site where the metal articles are to be used.

When metal articles such as I beams, machinery parts, sheets, plates, grating, pipe and miscellaneous other metal articles are manufactured, the manufacturing site for the metal articles usually is a long distance from the site of construction of the machinery, building, etc. where the metal articles are to be assembled or otherwise used. Thus, the metal articles must be transported from the manufacturing facility to the construction site, and the articles frequently must be stored prior to being assembled or otherwise used. Although the articles may be coated with paint or another rust preventive coating, the protective coatings tend to become damaged during handling of the articles so that the articles are not completely protected as desired.

In some machinery, equipment or building structures it is highly desirable to receive and to assemble the metal articles in virtually perfect condition, without the presence of any surface contaminants. To provide the metal articles in this condition requires the builder or subcontractor to manually treat the articles after delivery thereof at the construction site to remove the contaminants unless a shot blast machine is also located at the construction site. The on-site manual cleaning processes usually are difficult and expensive to undertake because of the massive size and weight of the metal articles, and the prior art cleaning and restoration processes usually must be performed in a controlled environment such as inside a large building.

SUMMARY OF THE INVENTION

Briefly described, the present invention comprises a shot blast machine which is relatively compact and which is constructed so that it can be partially dismantled and stacked in a movable configuration, and then moved from one construction site to another, and subsequently reassembled and used. The shot blast machine includes a sectional conveyor assembly that includes an entrance section, a central section and an exit section, and the entrance and exit sections can be loaded onto the central section, by extending the entrance and exit sections through the blast chamber and entrance and exit vestibules of the shot blast machine.

Another feature of the invention is an improved shot conveyor system that comprises a central auger conveyor extending longitudinally beneath the blast housing and entrance and exit vestibules, with a canopy extending over the auger screw that meters the shot to the auger and prevents overloading the auger. Additionally, the central auger conveyor with its canopy functions as a storage means for the shot, whereby the shot is stored in the lower portion of the shot blast machine, both during operation of the machine and during times when the machine is inactive or being transported from one construction site to the next.

Another feature of the invention is the air circulation system, wherein air from the atmosphere is directed inwardly through the entrance and exit vestibules, then through a separator where debris is removed from the shot and carried with the air to a filter.

Thus, it is an object of this invention to provide a shot blast machine that is relatively compact and is movable from one construction site to another.

Another object of this invention is to provide a shot blast machine which stores the shot in the lower portion of the machine and which prevents the weight of the stored shot from bearing directly on a central auger which recirculates the shot from its storage area to the shot propellers.

Another object of this invention is to provide a shot blast machine that has entrance and exit conveyors that can be temporarily stored by extending the conveyors through the blast housing and entrance and exit vestibules of the shot blast machine.

Other objects, features and advantages of the present invention will become apparent upon reading the following specification, when taken in conjunction with the accompanying drawings.

DETAILED DESCRIPTION

Figure 1:
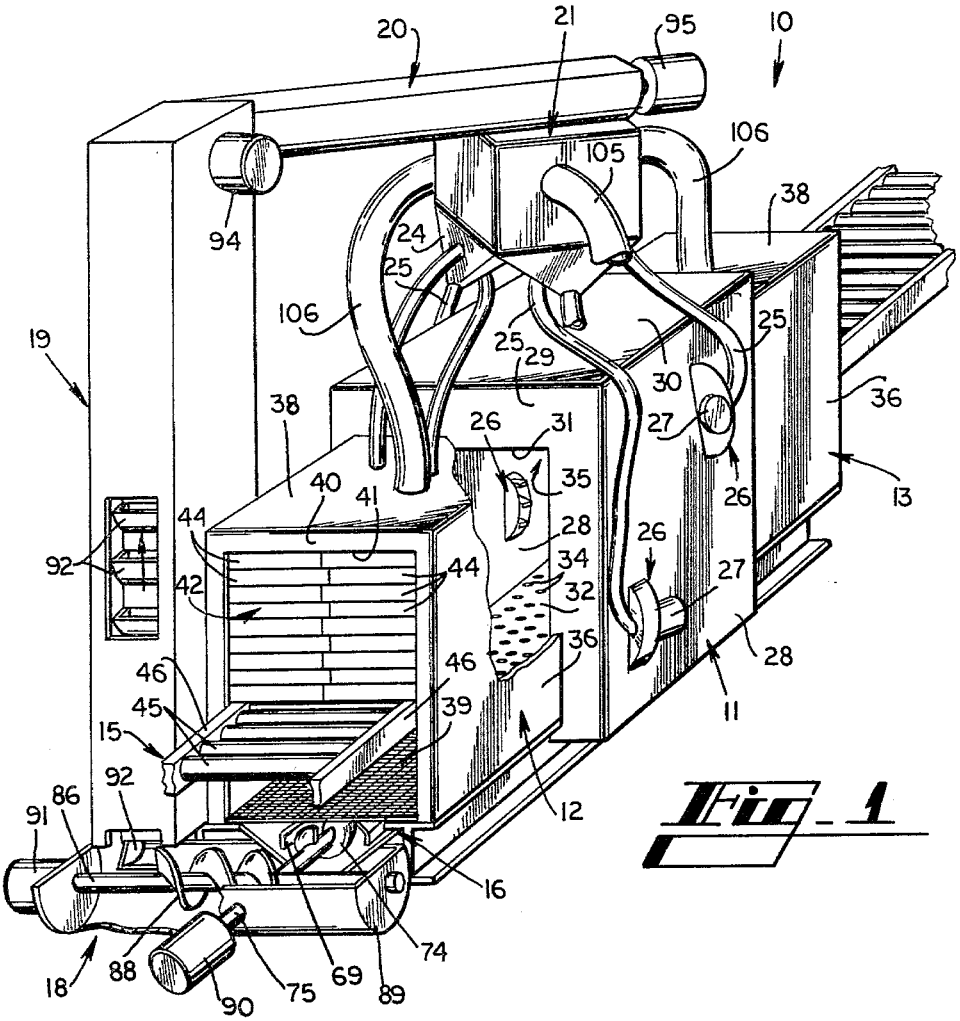
FIG. 1 is a perspective illustration of the shot blast machine, with the conveyor and other portions being broken away for clarity.

Referring now in more detail to the drawings, in which like numerals indicate like parts throughout the several views, FIG. 1 illustrates the shot blast machine 10 which includes a shot blast housing 11, entrance vestibule housing 12 and exit vestibule housing 13. A roller conveyor assembly 15 extends through the entrance and exit vestibule housings 12 and 13 away from blast housing 11. A central auger conveyor 16 extends longitudinally beneath blast housing 11 and entrance and exit vestibule housings 12 and 13, cross auger conveyor 18 extends from the delivery end of the central auger conveyor 16 to the side of entrance vestibule housing 12, and bucket elevator conveyor 19 extends from the delivery end of cross auger conveyor 18 upwardly. Upper auger conveyor 20 extends from the upper delivery end of bucket elevator 19 to separator 21 which is located over blast housing 11. Shot hoppers 24 form the bottom wall of separator 21, and shot conduits 25 extend downwardly from the lower opening of each shot hopper to one of the shot propeller assemblies 26.

The shot propellers 26 are rotated by shot motors 27. There are two shot propellers mounted to each side wall 28 of the blast housing 11, and each shot propeller is angled so as to propel the shot at a different angle toward the articles moved through the shot blast machine. For example, the lower shot propeller 26 on one side wall is angled somewhat toward the entrance vestibule 12 and its shot is propelled in an upward direction so as to clean the leading end surface, the bottom surface and one side surface of the articles being cleaned. The upper shot propeller 26 on the same side wall is angled somewhat toward the exit vestibule, and propels its shot in a downward incline, so as to clean the top surface, the trailing surface and the same side surface of the articles being cleaned. With this arrangement of the shot propellers on both sides of the passageway, all surfaces of the articles moved through the passageway will be cleaned.

Blast housing 11 includes upright parallel opposed side walls 28, upright opposed end walls 29 and top wall 30. Openings 31 are formed in end walls 29 and form a passageway through blast housing 11. Floor surface 32 is formed between the side walls and end walls 28 and 29, and a plurality of openings 34 extend through floor 32. Normally, the floor 32 is substantially covered with shot and the shot is flowable to the extent that it will drain through the openings 34. The interior surfaces of the side walls 28 of blast housing 11 are fabricated with a hardened metal such as manganese steel. Thus, the hardened interior surfaces of side walls 28 and the layer of shot on floor 32 resists the wear that might otherwise be experienced by these surfaces from the shot propelled inwardly of the blast housing 11 by shot propellers 26, and the side walls, end walls, top wall and floor of the blast housing thereby define a blast chamber 35.

Entrance vestibule housing 12 and exit vestibule housing 13 are structurally similar to each other in that each includes upright, parallel opposed side walls 36, horizontal top wall 38, open floor 39 and end wall 40. Floor 39 comprises an open grate which permits the downward movement therethrough of shot. End wall 40 forms an opening 41 in each of the vestibules 12 and 13, and the openings 31 of blast housing 11 and openings 41 of the vestibules are aligned with one another and define a passageway through the shot blast machine for the articles to be cleaned.

Both the entrance and exit vestibules 12 and 13 have a plurality of shot deflector doors 42 that close the passageway through the shot blast machine. Each deflector door 42 includes a plurality of flexibile straps 44 which are supported at their ends in the vestibule housings in a cantilever arrangement, so that when an object is moved through the opening 41, it pushes only those straps that it contacts out of its way as it passes through the opening. Since there are a plurality of the shot deflector doors 42 in both the entrance and exit vestibules 12 and 13, any movement of shot out of the vestibule openings 41 is retarded. The distal ends of the straps 44 normally overlap one another.

Figure 5:
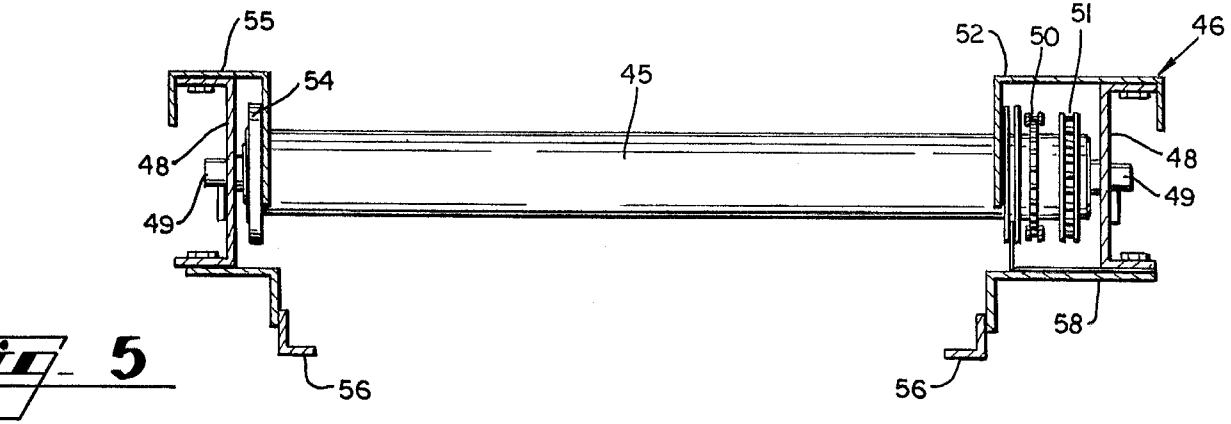
FIG. 5 is an end cross sectional view of the entrance conveyor section.

Roller conveyor assembly 15 comprises a plurality of spaced parallel rollers 45 rotatably supported at their ends by side frames 46. As illustrated in FIG. 5, the side frames each comprise elongated channel beams 48 with the roller bearings 49 extending from the rollers through the beams. Sprockets 50 and 51 are mounted on one end of each roller 45, and chains (not shown) are connected between adjacent ones of the rollers, about sprockets 50 and 51. Chain guard 52 extends from channel beam 48 over sprockets 50 and 51 of each roller and over the connecting chains between the rollers. A rubber washer 54 is mounted on the other end of each roller 45 and a similar guard 55 extends from channel beam 48 over the rubber washers 54. Storage support rails 56 are mounted to channel beams 48 by means of a plurality of brackets 58. The storage support rails 56 are positioned inwardly with respect to chain guard 52 and end guard 55.

Figure 2:
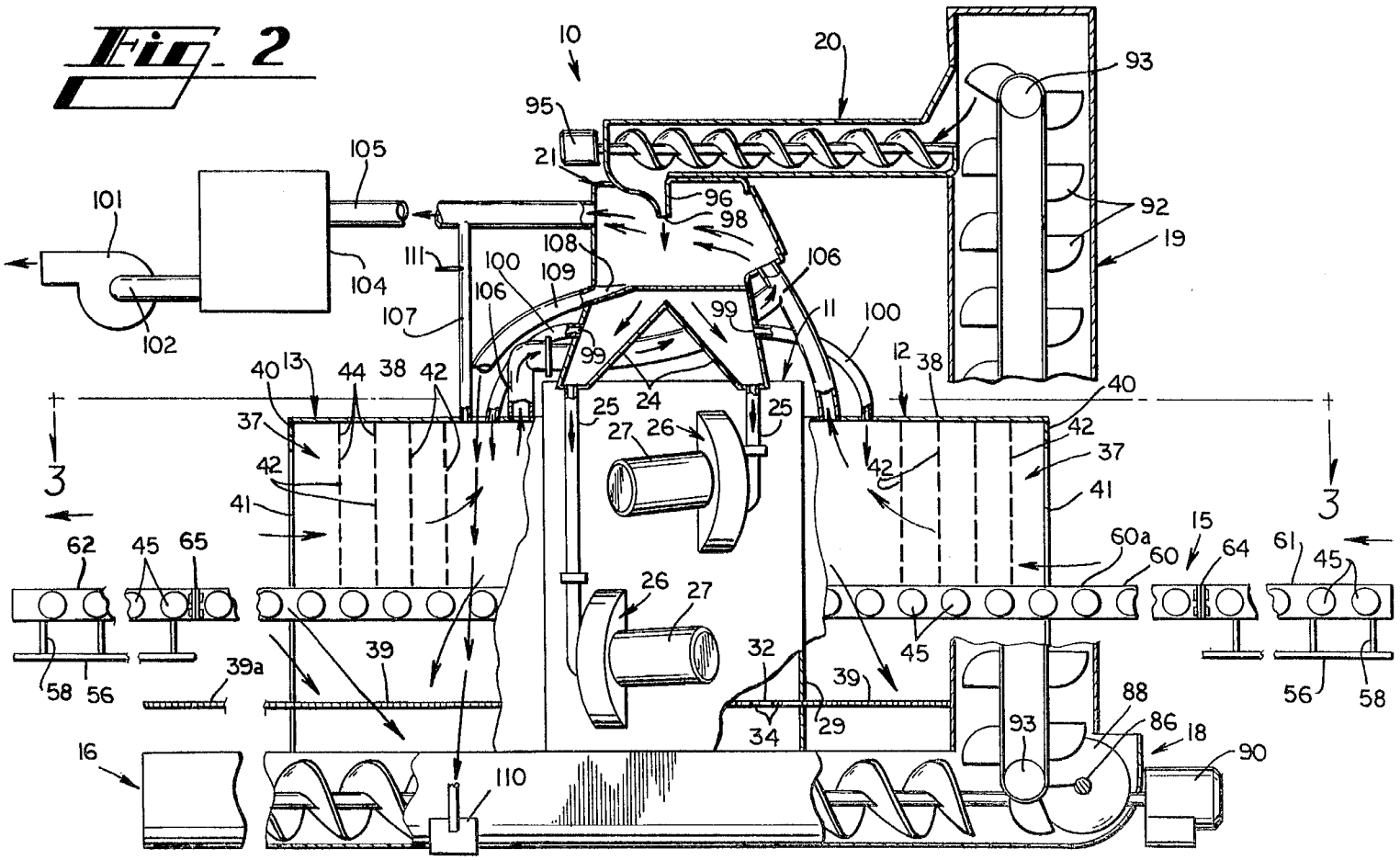
FIG. 2 is a schematic side elevational view of a shot blast machine, showing the flow of air and shot and air through the machine.
Figure 3:
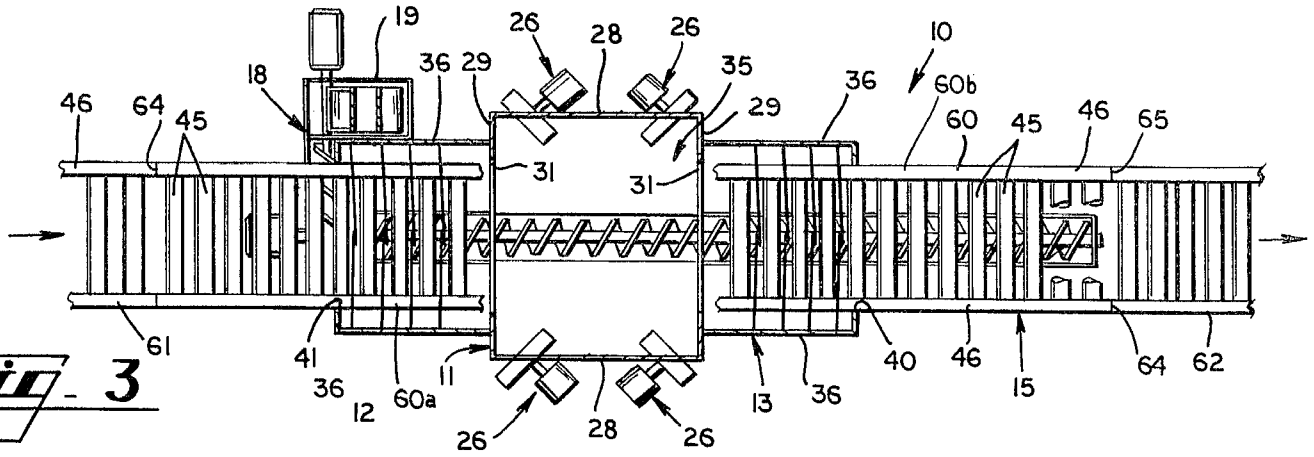
FIG. 3 is a top plan view of the lower portion of the shot blast machine, taken along lines 3—3 of FIG. 2.

As illustrated in FIGS. 2 and 3, roller conveyor assembly 15 is divided into three sections: central section 60, entrance section 61 and exit section 62. Central section 60 is subdivided into entrance subsection 60*a* which extends from an opening 31 of blast housing 11 on through entrance vestibule housing 12, through the opening 41 of entrance vestibule housing 12, and beyond. In a similar manner, central subsection 60*b* of roller conveyor assembly 15 extends from an opening 31 of blast housing 11, through exit vestibule 13, on through the opening 41 of the exit vestibule housing, and beyond. In the embodiment illustrated, there is no conveyor means extending through blast chamber 35.

Entrance section 61 of roller conveyor assembly 15 is releasably connected at 64 to and in alignment with central section 60, while exit section 62 is releasably connected at 65 to and in alignment with central section 60. When the entrance and exit sections 61 and 62 of roller conveyor assembly 15 are disconnected from central section 60, the end sections can be placed one upon the other on central section 60, by the storage support rails 56 of a section resting on the rollers 45 of a section therebelow. The entrance and exit sections 61 and 62 of the conveyor assembly can be projected through the passageway of the shot blast machine, so that they extend through the openings 31 and 41, right through blast chamber 35 and vestibule chambers 37. The rollers of central section 60 can be operated to move the entrance and exit sections 61 and 62 along the surface of the central section when moving the entrance and exit sections into or out of their stored positions.

Figure 4:
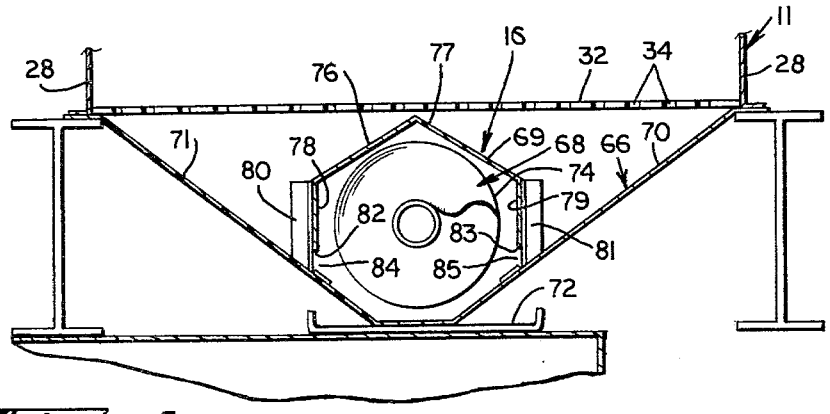
FIG. 4 is an end cross sectional view of the central auger conveyor.

As illustrated in FIG. 4, central auger conveyor 16 comprises conveyor recess 66, auger screw 68 and canopy 69. Conveyor recess 66 comprises downwardly converging side walls 70 and 71 and bottom wall 72. The side walls extend from the side walls 28 of blast housing 11, beneath floor 32 and converge downwardly and inwardly beneath auger screw 68. Auger screw 68 comprises helical screw 74 mounted on rectilinear axle 75, with the axial being rotatably supported at its ends by suitable bearings (not shown). Canopy 69 includes downwardly and outwardly diverging sloped upper wall sections 76 and 77 and downwardly turned side walls 78 and 79. A plurality of supporting brackets 80 and 81 are attached to side walls 78 and 79 and hold the lower edges 82 and 83 of the canopy side walls in spaced relationship with respect to the converging side walls 70 and 71 of the conveyor recess 66. Thus, openings 84 and 85 are formed between the lower edges 82 and 83 of the canopy 69 and the converging side walls 70 and 71 and the openings 84 and 85 are positioned below the axis of rotation of the auger screw.

With this construction, the shot that passes through the floor 32 of the blast chamber or the floors 39 of the vestibules 12 and 13 moves down the inclines of the side walls 70 and 71 of the conveyor recess 66 and down the sloped upper wall sections 76 and 77 of the canopy 69, toward and through openings 84 and 85. The flow of shot continues in this manner until the shot accumulated beneath canopy 69 reaches the angle of repose of the shot about the helical blade 74 of auger 68, and then the shot begins to accumulate above openings 84 and 85, about the canopy and eventually on top of the canopy. When the helical blade 74 of the auger is rotated, it tends to convey the shot beneath canopy 69 longitudinally of the auger conveyor, so that more shot can move downwardly through the openings 84 and 85. Thus, the auger screw 68 does not have to bear the direct load of the shot stored in the lower portion of the shot blast machine, but the shot can be accumulated and stored about the auger conveyor and can be progressively fed to the central auger conveyor on a demand basis.

Cross conveyor 18 includes a rectilinear axle 86 which extends across axle 75 of central auger conveyor, and a helical screw blade 88 is mounted about the axle. The blade 74 of central auger conveyor 16 is foreshortened so that it does not interfere with the blade 88 of the cross auger conveyor, and the blade of the cross auger conveyor is foreshortened so that it does not bind with the axle 75 of the central auger conveyor. Conveyor trough 89 extends longitudinally beneath axle 86. Central auger conveyor 16 is driven by fluid motor 90, while cross auger conveyor 18 is driven by fluid motor 91.

Bucket elevator conveyor 19 has its lower entrance end in communication with the delivery end of cross conveyor 18, and the path of the buckets 92 is through the delivery end of the trough 89 of the cross conveyor. Their arrangement is such that each bucket 92 moves closely adjacent the axle 86 of the cross auger conveyor, so as to scoop the shot from the delivery end of the cross auger conveyor and to elevate the shot. Bucket elevator conveyor 19 is of conventinal construction in that it includes a series of buckets 92 mounted on continuous conveyor chains, with the chains being guided by upper and lower sprockets 93 with the upper sprocket being driven by fluid motor 94. The bucket elevator conveyor 19 delivers the elevated shot to one end of the upper auger conveyor 20.

Upper auger conveyor 20 is driven by fluid motor 95 and transports the shot from bucket elevator conveyor 19 to separator 21.

Separator 21 includes an upper hopper 96 (FIG. 2) and the shot is fed to the hopper 96 by upper auger conveyor 20. The lower opening 98 of the hopper 96 discharges the shot in a screen-like cascade to shot hoppers 24. The arrangement of the shot hoppers 24 is to receive some of the shot from the stream of shot and the shot is guided by the shot hoppers 24 downwardly to the shot conduits 25, then to shot propellers 26.

An overflow opening 99 is formed in the upper portion of each shot hopper, and an overflow conduit 100 is connected at its upper end to an overflow opening 99 of each shot hopper and communicates at its lower end with an entrance or exit vestibule housing 12 and 13. With this arrangement, if the shot accumulated in any of the shot hoppers 24 reaches a level above an overflow opening 99, the upper portion of the shot in the shot hopper will be moved under the influence of gravity downwardly through the overflow conduit back to an entrance or exit vestibule housing, and permitted to fall to the floor 39 of the vestibule housing. Since the floors of the vestibule housings are open, the shot is able to pass back to the central auger conveyor assembly, where it awaits recycling.

Blower 101 has its inlet conduit 102 connected to the exhaust of air filter housing 104. Air conduit 105 extends from the entrance of air filter housing 104 to separator 21. Branch air conduits 106 are each connected at one of their ends to the opposite side of separator 21, and are connected at their other ends to vestibule housings 12 and 13. Thus, blower 101 functions to suck air through the openings 41 of vestibule housing 12 and 13, then through branch air conduits 106 to one side of separator housing 21, then through the stream of shot falling from upper shot hopper 96, then out of separator housing 21 through conduit 106 to filter housing 104. The flow of air inwardly through the vestibule housings 12 and 13 tends to inhibit any airborn debris from escaping out through the vestibules, and the movement of air through the stream of shot in separator housing 21 causes the lighter particles moving with the shot to become airborn and move with the air to filter housing 104. The particles carried with the air to the filter housing are filtered from the air, so that the air discharged to the atmosphere is substantially debris-free.

When the stream of air moves through the stream of shot in the separator 21, the heavier shot continues to move downwardly and the lighter debris becomes airborne and moves with the air to the filter housing 104. Particles that have an intermediate density tend to move laterally because of the influence of the laterally directed stream of air, and those particles are directed to the refuse hopper 108 in separator housing 21. Refuse conduit 109 extends from the lower opening of refuse hopper 108 in a downward direction and is usually suspended over a bucket or other receptacle 110. With this arrangement, the low density solids will be removed from the shot and will not be carried to the filter housing 104.

By-pass conduit 107 extends between exit vestibule housing 13 and air conduit 105, and gate valve 111 is positioned in by-pass conduit 107. The function of by-pass conduit 110 is to balance the air flow of the system, so that an increased or reduced amount of air can be pulled through separator 21 and vestibules 12 and 13 by closing gate valve 111, or a reduced amount of air can be pulled through the separator and vestibules by opening gate valve 111.

Floor 39 of exit vestibule housing 13 extends beyond the vestibule at **39*a*. Also, central auger conveyor 16 extends beyond exit vestibule 13. Air hoses (not shown) are supplied to workers at the opening of exit vestibule housing 13, and the articles being cleaned which pass through the exit vestibule 13 are further air cleaned by the workers "blowing off" the articles. The shot and debris removed in the blowoff area over the floor section 39*a* pass through the open floor section to the central auger conveyor 16**, so that it is returned to be recirculated with the other shot through the shot blast system.

While the invention is disclosed as a "shot blast" system, it should be understood that the abrasive used in the system can be of varying grades, from a small grit to a relatively large shot. It should be understood, of course, that the foregoing relates only to a preferred embodiment of the present invention and that numerous modifications or alterations may be made therein without departing from the spirit and scope of the invention as set forth in the appended claims.

We claim:

1. A shot blast machine comprising a blast housing defining a blast chamber, aligned entrance and exit openings on opposite sides of said blast housing, an entrance vestibule housing in abutment with said blast housing and defining an entrance vestibule about the entrance opening of said blast housing, an exit vestibule housing in abutment with said blast housing and defining an exit vestibule about the exit opening of said blast housing, said vestibule housings each defining openings therein in alignment with the entrance and exit openings of said blast housing, shot propelling means mounted to said blast housing for propelling shot inwardly into said blast housing, shot hopper means positioned over said blast housing for delivering shot to said shot propelling means, an open surface conveyor means for moving objects to be blasted along a substantially rectilinear path through the openings of said entrance vestibule housing, said blast housing and said exit vestibule housing, shot recirculation apparatus for collecting the shot beneath said blast chamber and the entrance and exit vestibules and moving the shot toward and delivering the shot to said shot hopper means, said shot recirculation apparatus including a canopy extending along the length of and beneath said open surface conveyor means, a conveyor recess positioned below said canopy and extending parallel to said canopy and including walls sloped downwardly from about opposite sides of said canopy, a central auger conveyor extending along the length of said recess beneath said canopy, elevator means for receiving shot from said central auger conveyor and delivering shot to said shot hopper, a hopper overflow means for directing shot from said shot hopper downwardly through said open surface conveyor to said canopy, said canopy defining openings with said conveyor recess on opposite sides of said auger screw at a level lower than the upper portion of the auger screw so that shot from said blast housing and said entrance and exit vestibule housings falls through the open surface conveyor means to and accumulates on and about the canopy of said auger conveyor and progressively feeds through said side openings to the lower portion of said auger screw, air circulation means comprising means for moving air from outside said shot blast machine inwardly through the openings of said vestibule housings and into the vestibule housings, and from the vestibule housings through air filter means to the atmosphere.

2. The shot blast machine of claim 1 and wherein said open surface conveyor means comprises a roller conveyor with a plurality of rollers supported in parallel spaced relationship in a substantially horizontal plane and extending along said rectilinear path, said article conveyor including a central section mounted to said entrance and exit vestibule housings, an entrance section detachably connected to said central section and an exit section detachably connected to said central section, said entrance and exit sections being sized and shaped to be stacked one upon the other, and when stacked one upon the other being of a height and width smaller than the height and width of said entrance and exit openings of said blast housing and of said entrance and exit vestibules so that when the entrance and exit sections are stacked one upon the other they can be loaded on said central section and extended through said entrance and exit vestibule housings and through said blast housing.

3. A shot blast machine comprising a blast housing defining a blast chamber, entrance and exit vestibule housings on opposite sides of said blast housing, said blast housing, entrance and exit vestibules defining aligned entrance and exit openings therethrough which form an article passageway aligned with said entrance and exit openings and extending through said entrance vestibule, said blast housing and said exit vestibule, a surface conveyor including an entrance section normally mounted at said entrance vestibule for transporting articles toward said entrance vestibule and said blast housing and an exit section normally mounted at said exit vestibule for transporting articles away from said blast housing and said exit vestibule, the entrance section and the exit section of said surface conveyor when stacked one upon the other being of a height and width smaller than said entrance and exit openings, whereby the entrance and exit sections of the surface conveyor can be stacked one upon the other and extended through said entrance and exit openings of the blast housing and entrance and exit vestibules when the shot blast machine is to be moved.

4. The shot blast machine of claim 3 and said surface conveyor comprises a roller conveyor and includes a central section extending through said entrance and exit vestibules, and wherein the entrance and exit sections of said roller conveyor are sized and shaped to be stacked upon the rollers of each other and upon the rollers of said central section, said central section comprises means for conveying said entrance and exit sections through said entrance and exit vestibules.

* * * * *